United States Patent [19]

Fujiyoshi

[11] Patent Number: 5,072,086

[45] Date of Patent: Dec. 10, 1991

[54] SWITCH DEVICE

[75] Inventor: Shiori Fujiyoshi, Kanagawa, Japan

[73] Assignee: Jimbo Electric Co., Ltd., Tokyo, Japan

[21] Appl. No.: 511,426

[22] Filed: Apr. 23, 1990

[30] Foreign Application Priority Data

May 1, 1989 [JP] Japan ..... 1-109109
Oct. 9, 1989 [JP] Japan ..... 1-262143

[51] Int. Cl.[5] ..... H01H 9/02

[52] U.S. Cl. ..... 200/332.1; 200/553; 200/339

[58] Field of Search ..... 200/529, 553, 557, 558, 200/559, 303.3, 339, 332.1, 408, 409

[56] References Cited

U.S. PATENT DOCUMENTS

| | | | |
|---|---|---|---|
| 1,736,849 | 11/1929 | Douglas | 200/553 X |
| 2,275,789 | 3/1942 | Meuer | 200/302.3 X |
| 2,808,482 | 10/1957 | Zanichkowsky et al. | 200/533 X |
| 3,435,169 | 3/1969 | Bienwald et al. | 200/339 X |
| 4,105,882 | 8/1978 | Ulbing et al. | 200/557 |
| 4,169,972 | 10/1979 | Black, III et al. | 200/339 X |
| 4,496,802 | 1/1985 | Rose et al. | 200/408 |
| 4,808,778 | 2/1989 | Fujiyoshi | 200/339 |
| 4,904,833 | 2/1990 | Sato et al. | 200/558 X |

FOREIGN PATENT DOCUMENTS

| | | | |
|---|---|---|---|
| 589314 | 12/1959 | Canada | 200/557 |
| 2413897 | 10/1975 | Fed. Rep. of Germany | 200/339 |
| 2060752 | 6/1978 | Fed. Rep. of Germany | 200/339 |

*Primary Examiner*—Henry J. Recla
*Assistant Examiner*—Glenn T. Barrett
*Attorney, Agent, or Firm*—Wegner, Cantor, Mueller & Player

[57] ABSTRACT

A switch device includes a housing including an upper member and a lower member, an actuator reversibly supported on actuator support portions in the upper member, a switch disposed in the housing, a translator disposed below the actuator and reversibly supported on translator support portions in said upper member for turning the switch on and off by the reversing action of the translator, and an interlocking mechanism for reversing said translator in the same direction as that of the reversing action of the actuator, the interlocking mechanism including pressing portions provided on said actuator and bearing portions provided on said translator with the surface of said bearing portions being formed into a given curved surface, and the pressing portions being provided with a V-shaped groove which contacts with said curved surface.

7 Claims, 6 Drawing Sheets

SWITCH DEVICE

BACKGROUND OF THE INVENTION

1. Field of the Invention

This invention relates to a switch device having a reversing interlocking mechanism which amplifies a reversing angle of an actuator to operate a switch mechanism.

2. Statement of the Prior Art

Heretofore, a kind of such a switch is disclosed, for example, in Japanese Patent Laid-Open No. 296,312/1987 filed by the present applicant. A reversing interlocking mechanism of the switch device disclosed in the above disclosure will be explained by referring to FIGS. 11 and 12. FIG. 11 is a longitudinal cross section of the main portion of the switch device. FIG. 12 is an explanatory view of operation of the switch shown in FIG. 11.

This switch device includes a switch mechanism which serves to open and close a connection between a movable contact and a stationary contact by reversing action of an actuator 2 in a housing having an upper member 1 and a lower member. The switch mechanism has a movable contact element carried reversibly on a conductive support to be electrically connected to a connecting terminal of an external electric wire and a translator 3 which directly reverses the movable contact element. The reversing action of the actuator 2 causes the connection between the movable contact and the stationary contact to open and close through the reversing action of the translator 3 and the movable contact element.

The translator 3 is formed in three teeth of a gear and is reversibly mounted on the upper member 1 with the tops of the teeth being directed upwardly. The translator 3 engages driving portion 4 which extends downwardly from the actuator 2 mounted reversibly on the upper member 1. The driving portion 4 is formed in two teeth of a gear which are mutually engaged with the translator 3.

However, in the switch device mentioned above, the actuator 2 and the translator 3 are disposed in confronting each other as if external gears mesh as shown in FIG. 12. A center A of rotation of the actuator 2 and a center B of rotation of the translator 3 are positioned away from an acting point C of force, respectively. Thus, the distance between the centers of rotation A and B becomes longer. Consequently, a distance from a support point of the movable contact element of the translator 3 to the top surface of the actuator 2 becomes longer. Accordingly, it is impossible to decrease a total height of the switch device.

In general, in this kind of the switch device, since it is necessary to positively operate an on-off action of the actuator and to operate positively an open and close action between the movable contact and the stationary contact, a reversing angle of the actuator 2 is set to be about 4 to 5 degrees while a reversing angle of the movable contact element is set to be about 9 to 10 degrees. Consequently, as mentioned above, if the height of the switch device becomes larger and the switch device is disposed in a wall of a building so that the surface of the actuator may not come out from the wall prominently, the housing of the switch device will have to project greatly into the wall and the flexibility in disposition of the device with respect to a thickness of the wall will decrease.

Also, in case the actuator 2 covers the whole top surface of the switch device, if the reversing angles of the actuator 2 and the movable contact element are set in a manner mentioned above, the strokes at both ends of the actuator become by far larger than as required.

SUMMARY OF THE INVENTION

An object of this invention is to provide a switch device in which an actuator is coupled to a translator to transmit a force therebetween in an engagement of internal gears and the centers of rotation of the actuator and translator are positioned in the same direction with respect to an acting point of the force and thereby to shorten a distance between the centers.

A switch device in accordance with this invention is characterised by a housing including an upper member and a lower member, an actuator reversibly supported on actuator support portions in said upper member, switch means disposed in said housing, a translator disposed below said actuator and reversibly supported on a translator support portions in said upper member for turning said switch means on and off by the reversing action of said translator, and interlocking mechanism for reversing said translator in the same direction as that of the reversing action of said actuator, the interlocking mechanism including pressing portions provided on said actuator and bearing portions provided on said translator, the surface of said bearing portions being formed into a given curved surface and said pressing portions being provided with a V-shaped groove which contacts with said curved surface.

The curved surface may be in an involute-curve or form an arched surface with the center which is the intersecting point between a vertical axis through a rotary center of said actuator support portions and a vertical axis through a rotary center of said translator support portions.

The switch device may further comprise a means for promoting a start of the reversing action of said translator at the time of start of the reversing action of said actuator.

The upper member may be provided with actuator bearing portions and translator bearing portions at the opposite walls which are positioned transversely to the reversing direction of said actuator and are provided with a shoulder. The actuator bearing portions bear said actuator support portions which extend oppositely in the transversal direction of said actuator and said translator bearing portions bear said translator support portions which extend oppositely in the transversal direction of said translator.

The switch means serving to open and close a connection between a movable contact and stationary contact by action of the reversin interlocking mechanism and the connecting terminals for external cables to be electrically connected to said switch means are disposed in said housing having said upper and lower members, said switch means has a movable contact element providing a movable contact reversibly supported on a support and is electrically connected to said connecting terminals, said switch means being able to open and close by reversing the translator in the same direction by reversing action of the actuator.

The actuator may include a detachable decorative operation plate which plate which overs substantially the whole top surface of said upper member.

In accordance with the switch device of this invention, the actuator can be reversed around the actuator support portions when one end of the actuator is pushed down. The V-shaped groove on the pressing portions of the actuator slidably contacts with the curved surface on the bearing portions of the translator to rotate the bearing portions around the axis of the translator support portions. The reversing angle of the actuator is amplified to reverse the translator greatly in the same direction by the action of the reversing-interlocking mechanism comprising the pressing and bearing portions.

In addition, in case the reversing promoting mechanism is provided, an input portion pushes down an acting portion of the translator at the beginning of the reversing action thereby promoting the start of the reversing action of the translator. Even if a start torque of the actuator is small, it is possible to readily effect the reversing action of the translator. Consequently, the movable contact of the movable contact element will connect to and disconnect from the stationary contact provided on one connecting terminals. An electric circuit between a pair of connecting terminals will be opened and closed through the action of the switch mechanism.

DETAILED DESCRIPTION OF THE PREFERRED EMBODIMENTS

Now the embodiments of the present invention will be explained with reference to the figures.

Referring now to FIGS. 1 through 10, an embodiment of a switch in accordance with this invention is explained.

Figure 1:
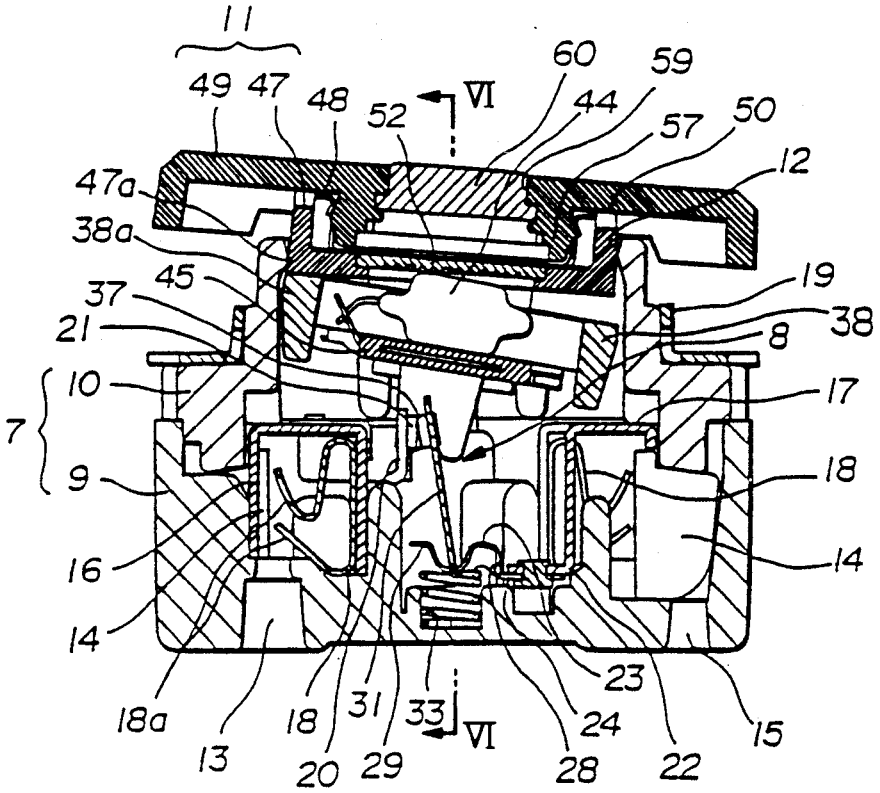
FIG. 1 is a longitudinal cross section of a switch device of an embodiment in accordance with this invention.
Figure 2:
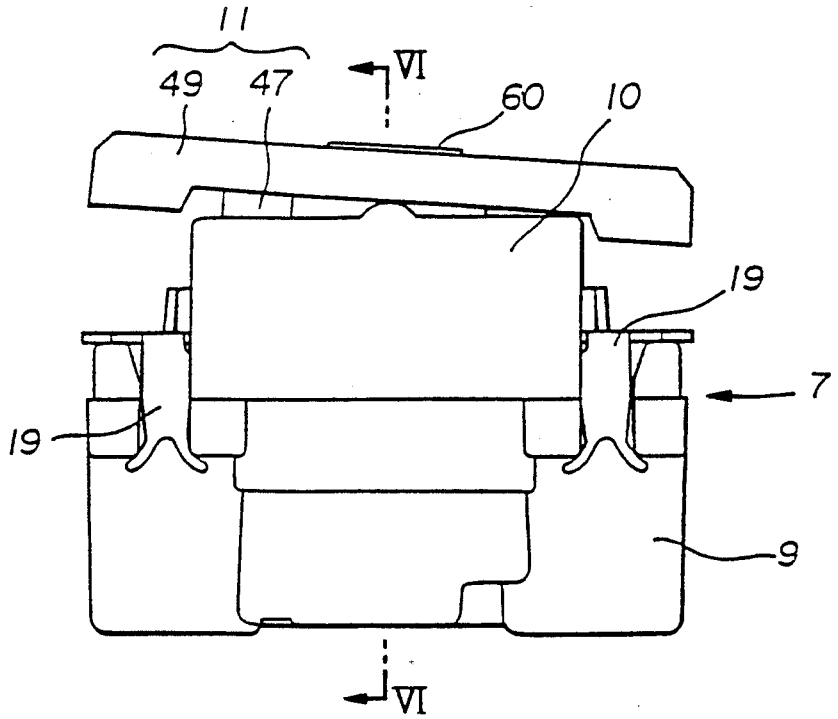
FIG. 2 is a front view of the switch device shown in FIG. 1.
Figure 3:
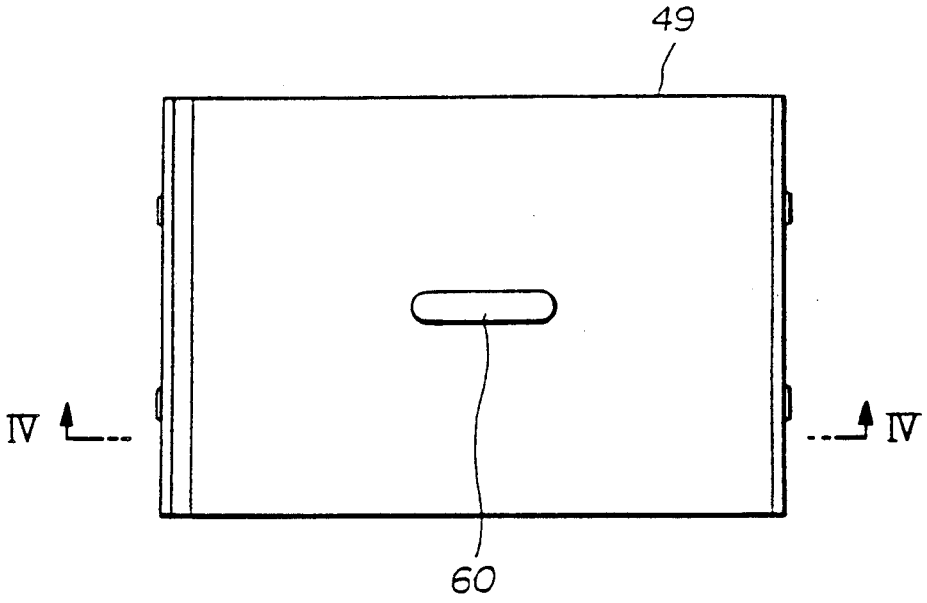
FIG. 3 is a plan view of the switch device shown in FIG. 1.

In the switch device of this invention, as shown in FIGS. 1 and 2, a housing 7 includes a lower member 9 with a cavity for receiving a switch mechanism 8 and other parts and an upper member 10 for closing an opening of said cavity formed in the upper portion of said lower member 9. An operation opening 12 is formed in the upper member 10 so that an actuator 11 extends outwardly from the opening 12. The lower member 9 has at the bottom wire insert apertures 13 to receive each of electric wires and tool insert apertures 15 to receive a tool for operating release buttons 14. A fastener 19 secures the upper member 10 to the lower member 9.

Such parts as connecting terminal elements 16, 17, holding springs 18 corresponding to the elements 16, 17, and the release buttons 14 are disposed in housing 7. Each of the connecting terminal elements 16, 17 is formed by bending a copper alloy plate in a U-shaped body. The connecting terminal element 16 is formed into contact piece 20 having stationary contact 21 at the top end by bending the element 16 outwardly at the middle point in the longitudinal direction.

The other connecting terminal element 17 is formed into a coupling piece 22 by bending the element 17 outwardly at the end in the longitudinal direction.

The coupling piece 22 is mounted on a connecting piece 24 of a support 23 and secured to the piece 24 by fixing means such as a rivet or the like to electrically connect the connecting terminal element 17 to the support 23.

Figure 7:
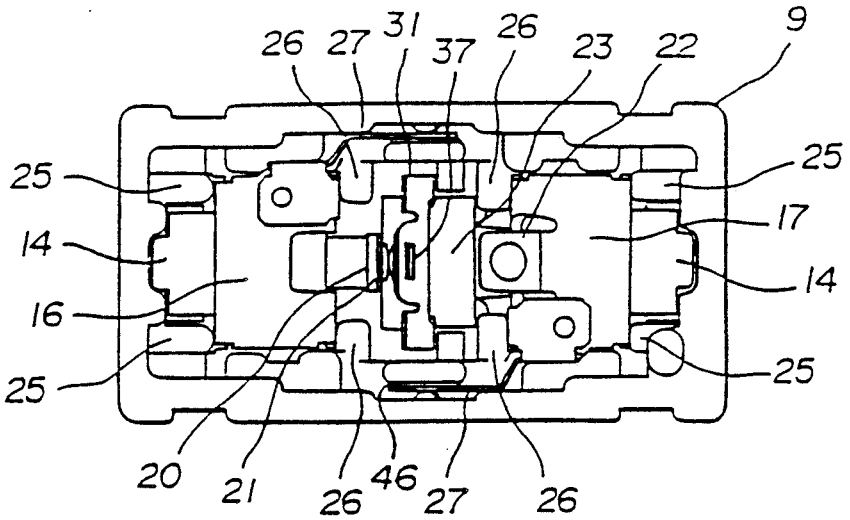
FIG. 7 is a plan view of FIG. 1 to illustrate the inside of a housing by removing an upper member.

A pair of the connecting terminal elements 16, 17 with their U-shaped openings directed towards the bottom of the lower element 9 are disposed between a pair of lateral protrusions 25 provided in the cavity of the element 9 and a pair of vertical protrusions 26 (see FIG. 7). Both protrusions 25 and 26 prevent the elements 16 and 17 from deflecting outwardly.

Figure 6:
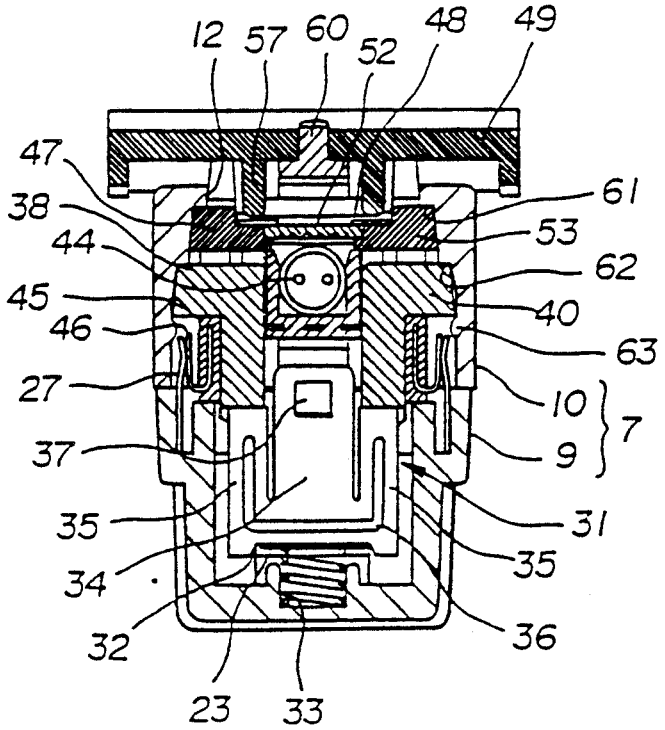
FIG. 6 is a cross section taken along line VI—VI in FIG. 1.

As shown in FIGS. 6 and 7, one end of an conductive plate 27 is connected to the upper side of each of the connecting terminal elements 16 and 17 by fixing means such as caulking or the like. The conductive plate 27 is bent longitudinally at the intermediate portion and the other end of the plate 27 faces opposite walls of the lower member 9.

Now, referring back to FIG. 1, the holding springs 18 have anchor ends **18*a* at the both ends of the springs so that the ends 18*a* can engage the electric wires to prevent the wires from being disengaged. The anchor ends 18*a* are formed by bending one of the ends of the holding springs 18 into a U-shaped form and the other end thereof into an S-shaped form. Inner end faces of the release buttons 14 disposed in the tool-insert apertures 15 oppose to the distal ends of the anchor ends 18*a*. By displacing the release buttons 14 to resiliently deflect the anchor ends 18*a*** by a tool such as a screwdriver, the electric wires can be released from being engaged.

The support 23 includes a leaf spring comprising the connecting piece 24, legs 28 extending upwardly from an end of the connecting piece 24, V-shaped piece 29 connected to the upper portion of legs 28. Legs 28 provide the V-shaped piece 29 with elasticity. Notches are formed on both sides of valley of the V-shaped piece 29. Narrower portions defined between the notches engage notches 32 (see FIG. 6) formed at the lower end and inside of a movable contact element 31.

A coil spring 33 supports elastically the V-shaped piece 29 from below. The movable contact element 31 is elastically supported from below by the elasticities of the coil sprig 33 and the support 23.

The movable contact element 31 has two slits formed on the opposite side of the notches 32 to define contact piece 34 positioned centrally and side pieces 35 contiguous on both sides of the contact piece 34. U-shaped raised portion 36 formed on side pieces 35 on both sides extending to the upper portion through the lower portion of the terminal piece 34 in a lateral direction increases the stiffness of side pieces 35 and assures the reversing action of the terminal piece 34 by the external force applied to said side pieces 35. Contact piece 34 has movable contact 37 and is disposed to oppose to stationary contact 21 of the terminal piece 34. When movable contact element 31 rocks around the support 23, movable contact 37 contacts with and separates from stationary contact 21 to open and close the electric circuit.

The support 23 and the movable contact element 31 are made of a plate having a high electric conductivity such as copper alloy or the like as in the case of the said connecting terminal elements 16 and 17.

Figure 10:
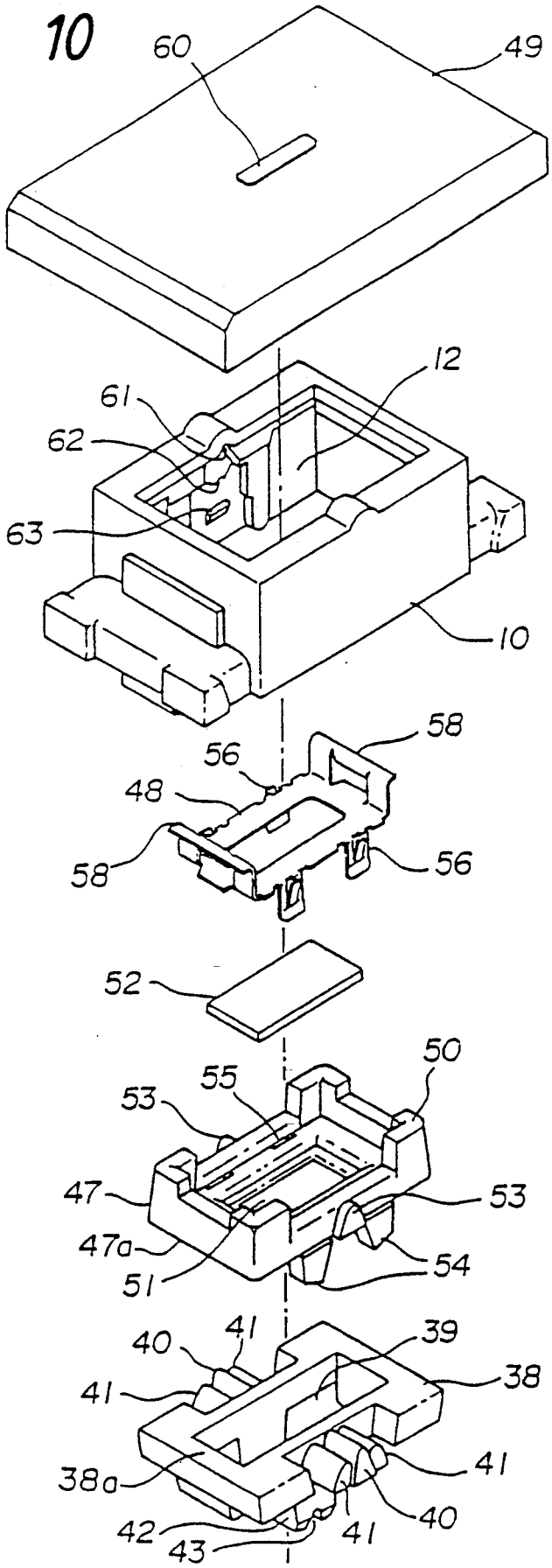
FIG. 10 is a decomposed perspective view of the main constituents of the switch of this invention.

A translator 38 supports reversibly an upper end of the side piece 35 of the movable contact element 31. The movable contact element 31 is reversed cooperatively with rocking of the translator 38. The translator 38 is formed into a frame body having a rectangular opening 39 at the center as shown in FIG. 10. On both sides of and in the middle of and in the longitudinal direction of the opening 39, are disposed a pair of translator support portions 40 and a pair of the bearing portions 41 which project sideway and a pair of action arms 42 which project downward.

The translator support portions 40 and the bearing portions 41 are formed by cutting the portions of the frame body into a V-shaped groove. The translator support portions 40 is formed in a tapered triangular pillar. The bearing portions 41 are mounted on both sides of the translator support portion 40. The bearing portions 41 have longitudinally an involute-curved surface or an arched surface. This surface assures a continuous contact which can transmit a power between the bearing portions and the pressing portions 54 mentioned below. Each of the action arms 42 has a V-shaped slit 43 which is formed in a direction intersecting with the longitudinal direction and extends at the center of the arms. The upper ends of the side piece 35 engages the slits 43.

As will be described hereinafter referring to FIG. 9 that the bearing portions 41 may have an arched-surface defined by a circle S of a radius defined in relation with the pressing portions 54 of the actuator 11 to be described later.

Figure 4:
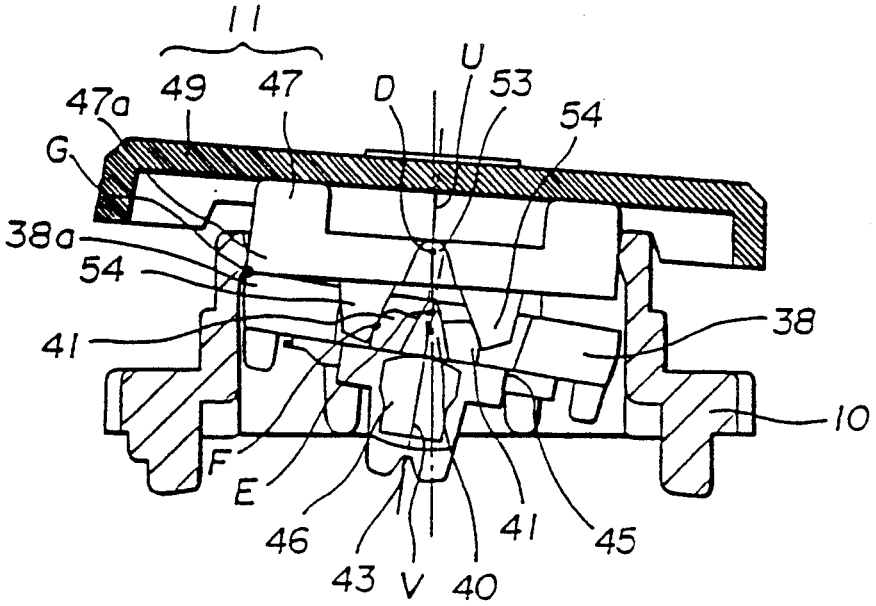
FIG. 4 is a cross section taken along line IV—IV in FIG. 3.
Figure 5:
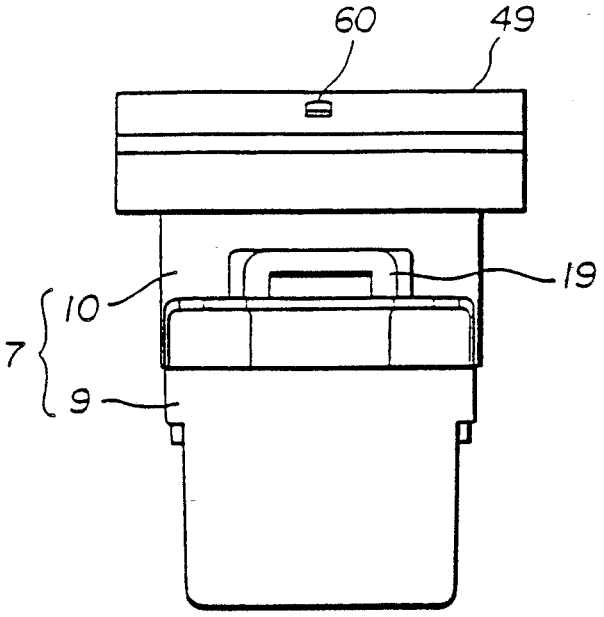
FIG. 5 is a right side view of the switch device shown in FIG. 1.

As shown in FIG. 1, a luminance indicator 44 such as a lamp is carried on the translator 38 through a holder 45. The holder 45 has a pair of engaging holes formed in a vertical direction on the opposite sides of the luminance indicator 44. The luminance indicator 44 is attached to the translator 38 by inserting the action arm 42 into the engaging holes of the holder 45, as shown in FIGS. 1, 4, and 6. Contacts 46 shown in FIGS. 4 and 6 are disposed on the opposite sides of the holder 45 so that the contacts 46 engage slidably the other end of the conductive plates 27 to supply an electric power.

The switch mechanism 8 comprising the support 23, the movable contact element 31 and the translator 38 serve to open and close the connection between the stationary contact 21 and the movable contact 37.

The actuator 11 includes an operation block 47 having an upper portion projecting from the operation opening 12 of the upper member 10 and a decorative operation plate 49 detachably mounted on the operation block 47 through a mounting spring 48. The operation block 47 has a rectangular edge portion 50 on the periphery and an opening 51 formed in a vertical direction at the center of the bottom. A shoulder is formed around the upper edge of the opening 51 providing a reflective plate 52 to permit lights uniformly to pass through by scattering the lights from the luminance indicator 44 and prevents the entry of dusts.

Further, on both sides of and in the middle of and in a longitudinal direction of the edge portion 50, are disposed a pair of the actuator support portions 53 which project sideway and a pair of the pressing portions 54 which project downward. The actuator support portion 53 is formed in a tapered triangular pillar. The pressing portions 54 have a pair of protrutions provided longitudinally at a given distance to form a prong-like shape. V-shaped grooves defined between the protrutions receive the bearing portions 41 of the translator 38. The reversing interlocking mechanism comprising the translator 38 with the bearing portions 41 and the actuator 11 with the pressing portions 54 serves to reverse the translator 38 in the same direction cooperatively with the action of the actuator 11.

Figure 9:
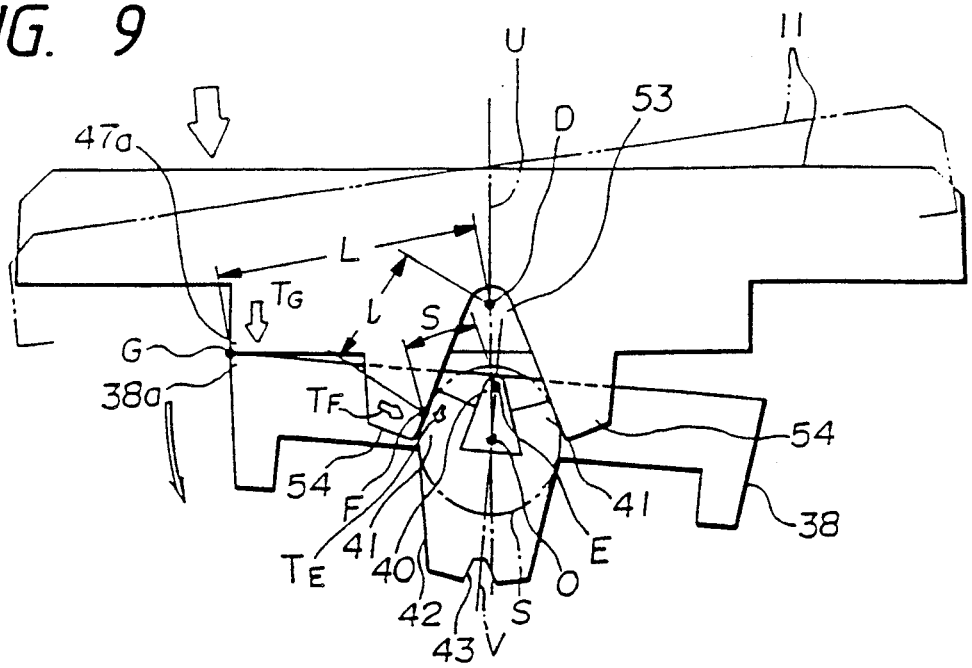
FIG. 9 is an explanatory view of operation of another reversing-interlocking mechanism.
Figure 11:
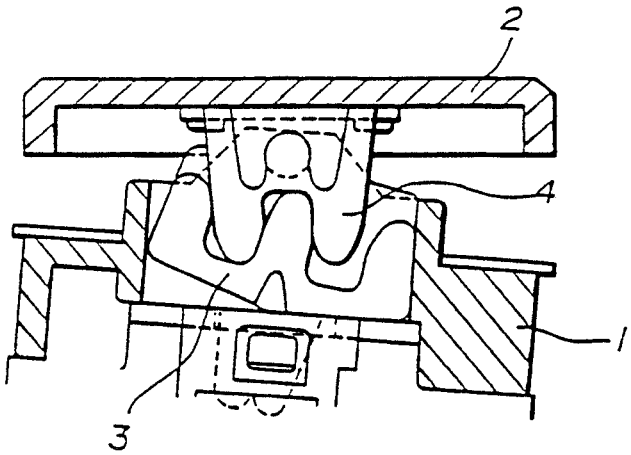
FIG. 11 PRIOR ART
FIG. 11 is a longitudinal cross section of the main portion of a switch device of prior art.
Figure 12:
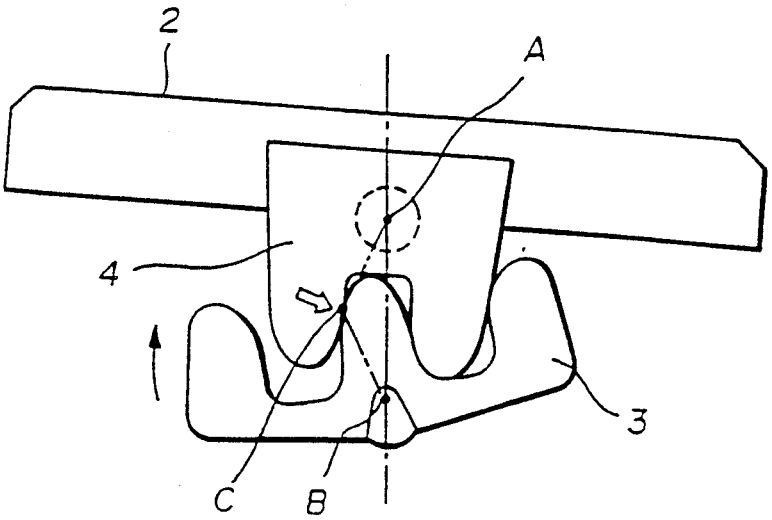
FIG. 12 PRIOR ART
FIG. 12 is an explanatory view of operation of the switch device of prior art.

Referring now to FIG. 9, another embodiment in accordance with this invention will be explained below. A center 0 of the arched surface of the bearing portion 41 is positioned on the intersecting point of a vertical axis U passing through a rotary center D of the actuator support portions 53 and a vertical axis V passing through a rotary center E of the translator support portion 40. The vertical axis U refers to a symmetry axis of plane of the actuator 11. The actuator support portions 53 and the pressing portions 54 are formed symmetrically with respect to the vertical axis U. Similarly, the vertical axis V is a symmetry axis of plane of the translator 38. The translator support portions 40, the bearing portions 41, and the action arm 42 are formed symmetrically with respect to the vertical axis V.

The reversing interlocking mechanism comprising the bearing portions 41 and the pressing portions 54 serves to effect the amplified reversing of the translator 38 in the same direction in connection with the operation of the actuator 11. A lower outer end of the edge portion 50 of the operation block 47 engages an upper outer end of the translator 38. The lower outer end of the operation block 47 defines an input portion **47*a*, while the upper outer end of the translator 38 defines an action portion 38*a*. A reversing promoting mechanism comprising the input portion 47*a* and the action portion 38*a* serves to promote a start of the reversing action of the translator 38 when the actuator 11** begins to reverse.

As shown in FIG. 10, holes 55 are provided on an inner periphery of the edge portion 50 of the operation block 47 to receive engaging pieces 56 formed on the sides of the mounting spring 48. The longitudinal opposite ends of the mounting spring 48 are pressed on the interior of the edge portion 50 to be held to the operation block 47 by the engaging force of the edge portion 50 and the engaging pieces 56. At the same time, the mounting spring 48 serves to prevent the reflective plate 52 from coming out.

The decorative operation plate 49 engages with the mounting spring 48 and held thereby has a rectangular frame portion 57 at the center of the bottom. The plate 49 is detachably coupled to the operation block 47 by engaging the frame portion 57 with concaves formed on upright pieces 58 of the opposite ends of the mounting spring 48. Further, a transparent plate 60 is secured to a window 59 formed in a vertical direction which is provided on the center of the frame portion 57 to pass the lights from the luminance indicator 44.

The upper member 10 which supports reversibly the actuator 11 and the translator 38 includes an inverted U-shaped actuator bearing portions 61 and an inverted V-shaped translator bearing portions 62. The bearing portions 61 and 62 are formed on the opposite walls positioned transversely to the reversing direction of the actuator 11 with the actuator bearing portions 61 are connected through a shoulder to the translator bearing portions 62, as shown in FIGS. 6 and 10. The center of the actuator bearing portions 61 provided in the upper position and the center of the translator bearing portions 62 provided in the lower position are set to be on the same vertical line. Detents 63 are formed below the translator bearing portions 62 to prevent the translator 38 from falling off.

The operation of the embodiments mentioned above will now be explained.

FIGS. 1 to 10 show the closed position of the switch mechanism 8. In the embodiment shown in the drawings, when the raised side of the decorative operation plate 49 of the actuator 11 (the left side in FIGS. 1 and 4) is pushed down, the operation block 47 formed integrally with the plate 49 through the mounting spring 48 is turned in the counter clockwise direction around the actuator support portion 53 rockingly held on the actuator bearing portions 61 of the upper member 10. The rocking force of the operation block 47 is transferred from the pressing portion 54 to the bearing portion 41 on the one hand and from the left end of the operation block 47 to the left end of the translator 38 on the other hand. Thus, the translator 38 is rockingly turned in the counter clockwise direction around the translator support portion 40 rockingly held on the translator bearing portion 62 of the upper member 10 like the actuator 11.

Figure 8:
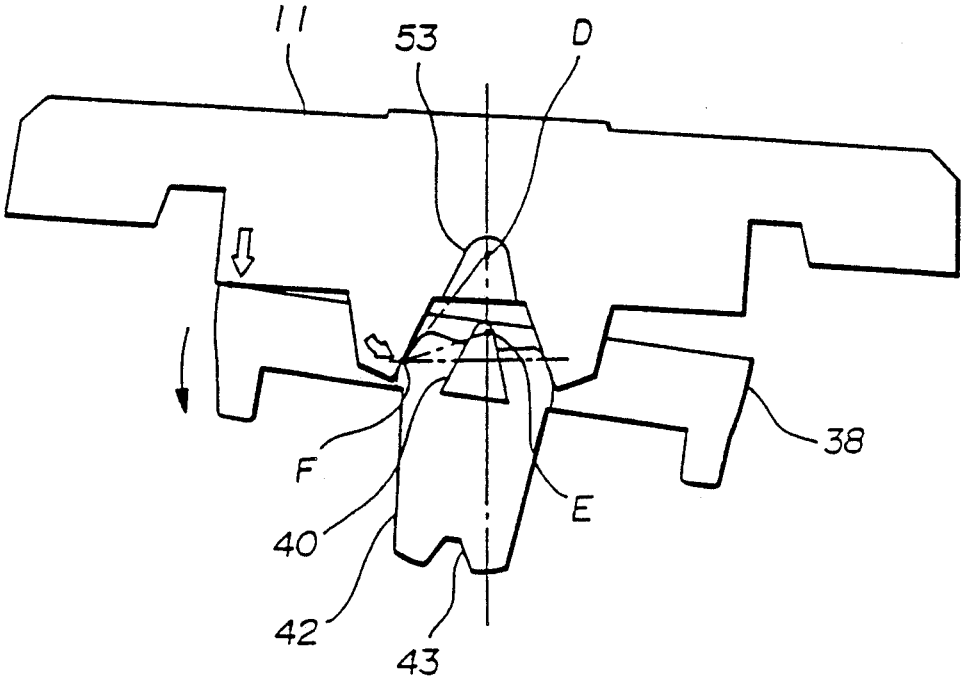
FIG. 8 is an explanatory view of operation of a reversing interlocking mechanism.

In this case, at first, the majority of the pressing force applied from the operation block 47 to the translator 38 is the pressing force from the left end of the operation block 47. The left end of the operation block 47 is moved away from the translator 38 immediately after the block 47 begins to move, thereafter only the pressing force of the pressing portion 54 acts to the translator 38 to reverse it. Such action of the translator 38 is caused by setting the reversing center D of the actuator 11 and the reversing center E of the translator 38 in the same direction with respect to the action point F of the above force as shown in FIG. 8 and by transferring the power from the actuator 11 to the translator 38 as in the relation of meshing of the internal gear and the pinion. This construction assures the translator 38 to rock greatly by increasing the reversing angle of the actuator 11 while the translator 38 is turned in the same direction as the direction of the actuator 11.

Further, since the surface of the bearing portions 41 is formed in a surface of a suitable curve such as an involute curve, and the curved surface engages continuously the interior of the pressing portions 54, a contacting position between the pressing portions 54 and the bearing portions 41 may be smoothly changed in accordance with a change in the pose of the actuator 11. Accordingly, the pose of the translator 38 is smoothly reversed in accordance with the change in the pose of the actuator 11.

Since the action arm 42 integrated to the translator 38 is rocked when the translator is rocked in the manner mentioned above, the side piece 35 of the movable contact element 31, the upper end edge of which engages the slit 43 provided on the lower end of the action arm 42, is reversely turned in the right direction around the concave of the V-shaped piece 29 of the support 23. Thus, the contact piece 34 having the movable contact 37 can reverse to follow the movement of the side piece 35 with a small amount of time lag. Consequently, the movable contact 37 reverses away from the stationary contact 21 to open the switch mechanism 8 and to release the conduction of the electric circuit. The right end of the decorative operation plate 49 of the actuator 11 is then raised.

Then, when the right raised end of the decorative operation plate 49 is pushed down, the actuator 11 is rockingly turned in clockwise direction to turn the translator 38 in the same direction and the contact piece 34 reverses in the left direction, since the action arm 42 integrated to the translator 38 causes the side piece 35 of the movable contact element 31 to reverse to the left. Thus, the movable contact 37 abuts on the stationary contact 21 to close the switch mechanism 8 and to conduct the electric circuit.

In the other embodiment shown in FIG. 9, when the raised side of the decorative operation plate 49 of the actuator 11 is pushed down, the operation block 47 formed integrally with the plate 49 through the mounting spring 48 is turned in the counterclockwise direction around the turning center D of the actuator support portion 53 rockingly held on the actuator bearing portion 61 of the upper member 10. The rocking force of the operation block 47 is transferred from the pressing portion 54 comprising the reversing interlocking mechanism to the bearing portion 41 on the one hand and from the input portion 47*a* at the left end of the operation block 47 defining the reversing-promoting mechanism to the action portion 38*a* at the left end of the translator 38 on the other hand. Thus, the translator 38 is turned in the counterclockwise direction like the actuator 11 around the center of rotation E of the translator support portion 40 rockingly held on the translator bearing portion 62 of the upper member 10.

In this case, at first, the majority of the pressing force applied from the operation block 47 to the translator 38 is the pressing force applied from the reversing promoting mechanism and is applied at the action point G. The action portion 38*a* of the translator 38 moves away from the input portion 47*a* of the operation block 47 immediately after the translator 38 begins to reverse cooperatively with the motion of the actuator 11. Thereafter, the pressing force from the reversing interlocking mechanism acts to the translator 38. In the reversing interlocking mechanism, the pressing force of the pressing portion 54 acts from the contact point F to the bearing portion 41 to allow the translator 38 to operate reversely around the rotary center E.

Such action of the translator 38 is caused by setting both the rotary center D of the actuator 11 and the rotary center E of the translator 38 at the upper position of the contact point F as shown in FIG. 9 and by transmitting the torque from the actuator 11 to the translator 38 in the relation of meshing of the internal gear and the pinion between the actuator 11 and the translator 38. This arrangement assures the translator 38 to reverse greatly by reversing the translator 38 in the same direction as the direction of the actuator 11 and amplifying the reverse angle of the actuator 11.

Given an L to a distance from the action point G on which the pressing force from the reversing promoting mechanism acts to the rotary center D of the actuator 11, l to a distance from the contact point F on which the pressing force from the reversing interlocking mechanism acts to the rotary center D, S to a distance from the contact point F to the rotary center E of the translator 38, a $\theta$ as an angle between a line connecting the contact point F to the rotary center D and a line connecting the contact point F to the rotary center E, and a $T_G$ to a force to be applied to the action point G, then a force $T_F$ to be applied to the contact point F is expressed as:

$$T_G \times L = T_F \times l$$

Therefore, $$T_F = T_G \times L/l$$

Here, $$L/L > 1,$$

accordingly, $$T_F > T_G$$

Given $T_E$ to a pressing force to be applied to the translator 38 in accordance with the action force $T_F$, the relationship between the action force $T_F$ and the pressing force $T_E$ can be expressed in:

$$T_F \times l = T_E \times S$$

$$T_E = T_F \times l/S$$

Here, $$l > S,$$

accordingly, $$T_E > T_F$$

Accordingly, it is possible to apply a large amount of pressing force to the translator 38 by applying a small amount of operation force to the actuator 11 and to positively effect the reversing action of the translator 38 with a small amount of torque of start.

Further, since the surface of the bearing portion 41 is formed in an arched surface which is a part of a circle S and the V-shaped groove of the pressing portion 54 engages the arched surface to always contact with each other at two points, a clearance between the actuator 11 and the translator 38 is not caused and it is possible to change a contact position between the pressing portion 54 and the bearing portion 41 in accordance with a change in pose of the actuator 11. Thus, it is possible to restrain a wear on the contact point F and to increase durability thereof and to assure smooth operation of the switch.

A series of processes of operating the switch device after the reversing action of the translator is effected in the manner stated above.

It will be understood from the foregoing descriptions that the present invention can obtain the following effects.

The reversing center of the actuator and that of the translator engaging at the pressing portions and the bearing portions respectively are positioned in the same direction with respect to the acting point of the force. Thus arrangement will correspond to a relationship of force transmission between an internal gear and a pinion which meshes the internal gear. Consequently, it is possible to amplify the reversing angle of the actuator and to reverse the translator greatly in the same direction as the direction of the actuator while keeping the distance between their reversing centers as short as possible.

In addition, the torque transmission between the actuator and the translator are effected through the relation of the internal gear-meshing. The centers of rotation of them are positioned in the same direction with respect to the acting point of the force. Accordingly, it is possible to amplify the reversing angle of the actuator and to reverse the translator greatly in the same direction as that of the actuator while keeping the distance between their centers of rotation as short as possible. It is possible to make the total height of the switch device small and to provide the switch device with a compact and simple construction, since the distance from the reversing point of the movable contact element to the top surface of the actuator is small. Thus, even if switch device is disposed on a wall of a building so that the surface of the actuator does not come out from the wall extremely, the switch device will not project greatly to the wall and the flexibility in disposition with respect to a thickness of the wall will increase.

Also, the actuator bearing portions are connected to the translator bearing portions through the shoulder on the opposite walls of the upper member. The actuator is provided with the actuator support portions which are carried on the actuator bearing portions. The translator is provided with the translator support portions which are carried on the translator bearing portions. This arrangement can obtain the reversing interlocking mechanism which has a simple construction and an easy assembly.

Even if the switch device has so large actuator that the decorative operation plate covers all of the upper surface of the actuator, it is possible to increase the reversing angle of the actuator and to greatly reverse the movable contact element. Accordingly, the amount of the strokes at the opposite ends of the actuator do not become unnecessarily large. In addition, a large amount of pressing force can be applied to the translator by applying a small amount of acting force to the actuator. The amount of a starting torque is so small that a positive action can be obtained.

The closing position (ON) of the switch mechanism should be on the right side by the standard on mounting the above kind of the switch device. Since the tilting direction of the actuator is the same as that of the translator, it is easy to know the open position or the closing position (OFF or ON) of the switch mechanism when the decorative operation plate is removed from the actuator.

I claim:

1. A switch device comprising:

a housing including an upper member and a lower member;

an actuator rockingly supported on actuator support portions in said upper member and movable about an axis in a first and a second direction;

switch means disposed in said housing;

a translator disposed below said actuator and rockingly supported on translator support portions in said upper member for turning said switch means on and off, said translator being rotatable about an axis in said first and said second directions; and an interlocking mechanism for interlocking the rocking of said translator with the rocking of said actuator so that both rock together in said first direction or second direction, said interlocking mechanism including pressing portions provided on said actuator and bearing portions provided on said translator, said bearing portions having a given curved surface, and said pressing portions being provided with a V-shaped groove which contacts with said curved surface.

2. A switch device according to claim 1 wherein said curved surface is of an involute-curve.

3. A switch device according to claim 1 wherein said curved surface is an arched surface having a center which is an intersecting point between a vertical axis through a rotary center of said actuator support portions and a vertical axis through a rotary center of said translator support portions.

4. A switch device according to claim 1, further comprising; a means for promoting a start of the rocking action of said translator at the time of start of the rocking action of said actuator.

5. A switch device according to claim 1 wherein said upper member is provided with actuator bearing portions and translator bearing portions at opposite walls which are positioned transversely to the reversing direction of said actuator and are provided with a shoulder, and wherein said actuator bearing portions bear said actuator support portions which extend oppositely in the transversal direction of said actuator and said translator bearing portions bear said translator support portions which extend oppositely in the transversal direction of said translator.

6. A switch device according to claim 1 wherein said switch means and connecting terminals for external cables to be electrically connected to said switch means are disposed in said housing including said upper and lower members, wherein said switch means include a movable contact element having said movable contact and are reversibly supported on a support electrically connected to said connecting terminals, wherein said switch means serves to open and close a connection between said movable contact and a stationary contact by the action of said reversing interlocking mechanism, and wherein the rocking action of said actuator causes said translator to open and close said switch means.

7. A switch device according to claim 6 wherein said actuator includes a detachable decorative operation plate which covers substantially whole top surface of said upper member.

* * * * *